United States Patent [19]

French

[11] Patent Number: 4,464,196

[45] Date of Patent: Aug. 7, 1984

[54] ACICULAR FERROMAGNETIC METAL PARTICLES

[75] Inventor: James E. French, Newark, Del.

[73] Assignee: Hercules Incorporated, Wilmington, Del.

[21] Appl. No.: 526,176

[22] Filed: Aug. 24, 1983

[51] Int. Cl.[3] ..... B22F 9/26; H01F 1/06

[52] U.S. Cl. ..... 75/0.5 AA; 75/0.5 BA; 75/251; 148/105

[58] Field of Search ..... 75/0.5 AA, 0.5 BA; 148/105; 428/403, 694; 423/632, 633

[56] References Cited

U.S. PATENT DOCUMENTS

| | | | |
|---|---|---|---|
| 4,050,962 | 9/1977 | Koester et al. | 75/0.5 BA |
| 4,133,676 | 1/1979 | Oshimura et al. | 75/0.5 AA |
| 4,133,677 | 1/1979 | Matsui et al. | 75/0.5 AA |
| 4,202,871 | 5/1980 | Matsumoto et al. | 423/632 |
| 4,251,592 | 2/1981 | Takedoi et al. | 428/403 |
| 4,305,753 | 12/1981 | French | 148/105 |
| 4,309,459 | 1/1982 | Tokuoka | 427/219 |
| 4,318,735 | 3/1982 | Mishima et al. | 148/105 |
| 4,318,961 | 3/1982 | Ide et al. | 428/425.9 |
| 4,342,589 | 8/1982 | Ohshima et al. | 75/0.5 BA |
| 4,344,791 | 8/1982 | Steck et al. | 75/0.5 AA |
| 4,347,291 | 8/1982 | Tokuoka | 428/694 |
| 4,348,430 | 9/1982 | Tokuoka et al. | 427/215 |
| 4,390,361 | 6/1983 | Sueyoshi et al. | 75/0.5 BA |
| 4,396,668 | 8/1983 | Saito et al. | 428/220 |

OTHER PUBLICATIONS

Ferrites: Proceedings of the International Conference, Sep.–Oct. 1980, Japan, pp. 633–637.

Magnetic Media Information Services International Newsletter, vol. V, No. 4, Apr. 1982, pp. 64–66. Publication date is not earlier than Aug. 30, 1982.

*Primary Examiner*—W. Stallard

*Attorney, Agent, or Firm*—Hazel L. Deming

[57] ABSTRACT

Acicular ferromagnetic metal particles consisting essentially of iron and having coercive forces greater than 1300 oersteds when the surface areas of the particles are not greater than 45 $m^2$/gram are described. The particles are obtained by reducing a hydrothermally produced $\alpha$-$Fe_2O_3$ with a gaseous reducing agent at a temperature of about 300° to 400° C.

4 Claims, No Drawings

ACICULAR FERROMAGNETIC METAL PARTICLES

This invention relates to acicular ferromagnetic metallic particles suitable for magnetic recording media and more particularly to acicular metallic particles consisting essentially of iron and having improved coercivities when the surface areas of the particles are not greater than about 45 $m^2$/gram. The invention also relates to a process for preparing the improved metallic particles by the gas phase reduction of iron oxides.

It is known that iron powders can be produced by the reduction of finely divided acicular particles of iron oxides with hydrogen or some other gaseous reducing agent. Generally, the reduction is carried out with hydrogen using carefully controlled processing parameters to achieve complete reduction within a practical time period, to minimize interparticle sintering and pore formation and to avoid appreciable change in the shape and size of the particles. Since the magnetic properties and particularly the coercivity of submicron metallic particles depend upon the metallic material, the particle perfection and the size and shape of the particle, the extent to which interparticle sintering and pore formation occur during the reduction cycle directly influences the magnetic properties of the metallic particles.

Various procedures have been suggested in the art for shortening the reduction period and/or lowering the temperature at which iron oxide particles are reduced to iron in order to minimize interparticle sintering. See, for example British Pat. Nos. 743,792 and 1,125,093; German OLS No. 2,212,934; and U.S. Pat. Nos. 3,598,568; 3,607,220; 3,837,839; 4,155,748; 4,165,232 and 4,305,753. In general, iron particles produced in accordance with the prior art anti-sintering procedures have improved magnetic properties over particles produced in the absence of such procedures.

The usual procedure for controlling or reducing the porosity which develops when water is removed from the crystal lattice of the iron oxide-hydroxide precursor during dehydration involves heating the particles at an elevated temperature, generally at about 500° C. to about 700° C. prior to the reduction step. Treatments of this type sometimes referred to as calcination, annealing or tempering are discussed for example in U.S. Pat. Nos. 3,702,270; 4,290,799; and 4,305,753 and Japanese Kokai No. 79/122699. A slightly different prereduction procedure is described in U.S. Pat. No. 4,344,791 and involves providing the iron oxide-hydroxide particles with a shape-stabilizing surface coating and heating the particles at 250° to 450° C. in an atmosphere containing water vapor at a partial pressure of at least 30 mbar. The acicular ferromagnetic iron particles produced according to U.S. Pat. No. 4,344,791 have higher coercivities than iron particles obtained from the coated oxide-hydroxide particles which have not been heated in the water vaporcontaining atmosphere prior to reduction. However, the coercivity of particles which are in the size range that has been found to be most useful for commercial applications from the standpoint of ease of dispersion and particle stability is considerably reduced over that which can be realized with much smaller particles. Thus the search continues for methods which will provide the optimum particle shape and size and maximum magnetic properties.

Now in accordance with this invention it has been found that the iron particles obtained by the reduction of certain acicular $\alpha$-$Fe_2O_3$ particles exhibit a coercivity:surface area relationship which is distinctly different from that realized when the precursor particles ae acicular goethite or lipidocrosite particles. Thus, now for the first time there are provided acicular iron particles having coercivities greater than 1300 oersteds at relatively low surface areas.

Accordingly, the present invention relates to acicular ferromagnetic metallic particles consisting essentially of iron and having an average diameter of 0.03 to 0.1 micron, a length to diameter ratio from about 5/1 to about 13/1, a specific surface area by the BET nitrogen method within the range of 20 to 45 $m^2$/gram and a coercivity in oersteds equal to at least the value defined by the equation $$\text{coercivity} = 1300 + 50\ (S-20)$$

where S is the specific surface area and is 20 to 30 $m^2$/gram, or a coercivity greater than 1800 oersteds when the specific surface area is greater than 30 $m^2$/gram, said coercivity being measured on dry, stable powder at a field strength of 10,000 oersteds and a packing density of 1.0 gram/$cm^3$, and to a process for producing the same by reducing specified $\alpha$-$Fe_2O_3$ particles into iron with a gaseous reducing agent at a temperature of about 300° to 400° C.

The $\alpha$-$Fe_2O_3$ particles which are reduced to metallic iron in accordance with the process of this invention are the single crystal, acicular particles formed directly by the hydrothermal treatment of an aqueous alkaline suspension of amorphous ferric hydroxide in the presence of a growth regulator agent which is an organic phosphonic acid, hydroxy carboxylic acid, salt of an organic phosphonic acid, salt of an hydroxy carboxylic acid, ester of an organic phosphonic acid or ester of an hydroxy carboxylic acid, $\alpha$-$Fe_2O_3$ particles having an average diameter of 0.02 to 2 micron, a length to diameter ratio of 2/1 to 20/1, and a specific surface area by the nitrogen BET method of from about 10 to 100 $m^2$/gram can be reduced in accordance with this invention to provide iron particles having outstanding magnetic properties. The $\alpha$-$Fe_2O_3$ particles can also contain small amounts up to a total of about 5 weight % of one or more modifying elements such as cobalt, nickel and other metals provided that the presence of such elements does not interfere with the formation of acicular $\alpha$-$Fe_2O_3$ particles or with the reducibility of the particles to iron.

Preparation of single crystal acicular $\alpha$-$Fe_2O_3$ particles is carried out by heating an aqueous alkaline suspension of amorphous ferric hydroxide at an elevated temperature from about 100° to 250° C. in the presence of an effective amount of an organic phosphonic acid or hydroxy carboxylic acid growth regulating agent dissolved in the system for a length of time sufficient to convert the amorphous ferric hydroxide into acicular $\alpha$-$Fe_2O_3$ particles and to provide crystals having a desired size range. The preparation of single crystal, acicular $\alpha$-$Fe_2O_3$ particles is described in U.S. Pat. No. 4,202,871 and the disclosure therein is incorporated herein by reference.

In carrying out the process of this invention, hydrothermally produced $\alpha$-$Fe_2O_3$ particles having an average diameter of 0.02 to 0.2 micron and a specific surface area of 10 to 100 $m^2$/gram are reduced to ferromagnetic iron particles conventionally. The reduction can be conveniently carried out by charging the particles to a furnace, heating to remove any water and then heating in a strong reducing atmosphere to reduce the oxide to metal. This can be accomplished by passing a gaseous reducing agent, preferably hydrogen, over the oxide at a temperature from about 300° C. to 400° C., preferably about 350° to about 400° C., for 1 to 8 hours. Following reduction, the metal particles are recovered conventionally, usually by cooling in an inert atmosphere and then slowly passivated at room temperature with a nitrogen-oxygen mixture or by anerobically transferring the cooled particles into an inert solvent such as toluene, filtering in air and then slowly drying the damp particles.

If desired, the $\alpha$-$Fe_2O_3$ particles can be treated with a water-soluble phosphorus-containing compound and with a cobalt and/or nickel compound prior to the reduction step in order to realize even further improvement in magnetic properties. Generally, and such is preferred, the amount of phosphorus used will be sufficient to provide from 0.1 to 5 and preferably from about 0.2 to about 2 weight % phosphorus and the total amount of cobalt and/or nickel compound used will provide 0.5 to 5 and preferably from about 0.5 to about 3 weight % of the metal. The treatment of iron oxide particles with phosphorus and cobalt and/or nickel is described in U.S. Pat. No. 4,305,753 and the disclosure therein is hereby incorporated by reference.

The acicular ferromagnetic metallic particles described by this invention contain iron as the major metallic ingredient and are particularly useful for magnetic recording tape manufacture. The particles have excellent magnetic properties of which the coercivity, remanence magnetization and magnetization retention are outstanding.

The invention is further described by the following examples which illustrate the best known embodiments of the invention. All percentages are by weight unless otherwise indicated. The specific surface area measurements were determined by the BET nitrogen method and the magnetic properties of the metallic particles were measured by a PAR vibrating sample magnetometer at a packing density of 1.0 gm/cm$^3$. The coercive force, $H_c$ (oersteds) was measured at a field strength of 10,000 oersteds, and the remanence magnetization, $\sigma_r$ (emu/gram) and saturation magnetization, $\sigma_s$ (emu/gram) were measured at a field strength of 5,000 oersteds (5K) and 10,000 oersteds (10K).

EXAMPLE 1

To a vessel charged with 4 liters of an aqueous solution of ferric sulfate containing 11.2 grams of iron per liter was added sufficient 5% aqueous sodium hydroxide to adjust the pH to 8.0. The red-brown amorphous precipitate which formed was filtered off, the filter cake was washed with hot water and the washed cake was resuspended in sufficient water to provide 1 liter of suspension. Next, 0.96 gram of aminotri(methylenephosphonic acid) and 0.32 gram of 1-hydroxyethylene-1,1'-diphosphonic acid and then 5% aqueous sodium hydroxide were added to the suspension to adjust the pH to 10.8. The suspension was heated in a closed vessel with stirring for 60 minutes at 170° C., following which time the suspension was cooled and then filtered and the filter cake was washed and air dried. The product (60 grams) was identified as $\alpha$-$Fe_2O_3$ by X-ray crystallography. Electron microscopic observations revealed that the product was acicular particles having an average length of 0.5 micron and an average diameter of 0.06 micron. The specific surface area of the particles was 30 m$^2$/gram.

The dried product was crushed through a 30-mesh sieve and a portion of the crushed material was transferred to a tubular furnace and reduced for 3 hours at 390° C. using a hydrogen stream of 3 liters per minute. The reduced product was transferred anerobically into toluene, then filtered in air and the filter cake slowly dried in air. The compositional analyses and the physical and magnetic properties of the resulting iron particles are reported below in Table 1 along with the analyses and properties of the products of the following examples 2 to 5 and control examples A to C.

EXAMPLE 2

Another portion of the crushed dried $\alpha$-$Fe_2O_3$ product of Example 1 equal to 33 grams and 600 ml of water were charged to a vessel equipped with an agitator. Agitation was commenced and 1.5 ml. of 1M phosphoric acid were added. Next, sufficient 1M sodium hydroxide was added to adjust the pH to 7.2 and then 11.75 ml of 1M cobalt sulfate were added and the slurry was stirred for 30 minutes. Then, 2.0 ml. of 1M phosphoric acid were added, the pH was adjusted to 9.0 with 1M sodium hydroxide and agitation was continued for 30 minutes. The resulting slurry was filtered, the filter cake was washed and the washed cake was oven dried. The dried cake was crushed through a 30-mesh screen and a portion of the crushed cake was transferred to a tubular furnace and reduced for 4 hours at 370° C. using a hydrogen stream of 3 liters/minute. The reduced product was transferred into toluene, then filtered in air and the damp product slowly dried in air.

EXAMPLE 3

To a vessel charged with 4 liters of an aqueous solution of ferric nitrate containing 7.2 grams of iron per liter was added sufficient 5% aqueous sodium hydroxide to adjust the pH to 8.0. The red-brown amorphous precipitate which formed was filtered off, the filter cake was washed with water and the washed cake was resuspended in sufficient hot water to give 1 liter of suspension. Next, 1.0 gram of 1-hydroxyethylene-1,1'-diphosphonic acid and then 5% aqueous sodium hydroxide were added to the suspension to adjust the pH to 9.3. The suspension was heated in a closed vessel with stirring for 2 hours at 200° C., following which time the suspension was cooled and filtered and the filter cake was washed with water and air dried. The product was 40 grams of acicular $\alpha$-$Fe_2O_3$ particles having an average length of 0.4 micron, and an average diameter of 0.03 micron. The specific surface area was 42 m$^2$/gram.

The dried product was crushed and a portion of the crushed product was transferred to a tubular furnace and reduced for 3.5 hours at 370° C. using a hydrogen stream of 5 liters/minute. The reduced product was transferred anerobically into toluene, then filtered in air and slowly dried in air.

EXAMPLE 4

The procedure of Example 2 was repeated except that an equal amount of the crushed dried $\alpha$-$Fe_2O_3$ product of Example 3 was substituted for the $\alpha$-$Fe_2O_3$ product of Example 1 and the reduction step was carried out for 3½ hours.

EXAMPLE 5

To a vessel charged with 4 liters of a cooled aqueous solution of ferric chloride containing 5.0 grams of iron per liter was added sufficient 5% aqueous sodium hydroxide to adjust the pH to 8.0. The red-brown amorphous precipitate which formed was filtered off, the filter cake was washed with water and the washed cake was resuspended in sufficient hot water to provide 1 liter of suspension. Next, 1.0 gram of 1-hydroxyethylene-1,1'-diphosphonic acid was added and the pH was adjusted to 9.0 with 5% aqueous sodium hydroxide. The resulting suspension was heated in a closed vessel with stirring for 2 hours at 200° C., following which time the suspension was cooled and then filtered and the filter cake was washed and air dried. The product was 25 grams of acicular $\alpha$-$Fe_2O_3$ particles having an average length of 0.4 micron, an average diameter of 0.028 micron and a specific surface area of 51 $m^2$/gram.

The dried product was crushed and a portion of the product was treated according to the procedure of Example 2 except that the reduction time was 3½ hours.

COMPARISON EXAMPLE A

The procedure of Example 2 was repeated except that: 33 grams of acicular geothite particles having a diameter of 0.06 micron, a length to diameter ratio of 12:1 and a specific surface area of 35 $m^2$/gram were substituted for the 33 grams of the dried $\alpha$-$Fe_2O_3$ product of Example 1; following drying and crushing, the particles were dehydrated and then heated for 2 hours in nitrogen at 600° C. prior to reduction; and reduction was carried out at 390° C. for 3 hours.

COMPARISON EXAMPLE B

The procedure of comparison example A was repeated except that the goethite particles had a diameter of 0.05 micron, a length to diameter ratio of 15:1 and a specific surface area of 55 $m^2$/gram.

COMPARISON EXAMPLE C

The procedure of comparison example A was repeated except that 33 grams of lepidocrosite particles having a diameter of 0.037 micron, a length:diameter of 18:1 and a specific surface area of 65 $m^2$/gram were substituted for the goethite particles and the dehydrated particles were heated for 1 hour in nitrogen at 550° C. prior to reduction.

TABLE 1

| Ex. No. | Composition, % by weight Element | % | Particle Diameter micron | Length to Width Ratio | Specific Surface Area($m^2$/g) | Magnetic Properties Hc | $\sigma_T$, emu/g 5K | $\sigma_T$, emu/g 10K | $\sigma_S$, emu/g 5K | $\sigma_S$, emu/g 10K | $\sigma_T/s$ at 5K |
|---|---|---|---|---|---|---|---|---|---|---|---|
| 1 | Fe | 91 | 0.04 | 8 | 20.6 | 1394 | 68 | 69 | 130 | 152 | 0.52 |
| | P | 0.5 | | | | | | | | | |
| 2 | Fe | 88 | 0.04 | 8 | 23.9 | 1566 | 71 | 72 | 153 | 154 | 0.53 |
| | P | 0.8 | | | | | | | | | |
| | Co | 1.9 | | | | | | | | | |
| 3 | Fe | 86 | 0.035 | 10 | 26.1 | 1697 | 69 | 70 | 124 | 144 | 0.56 |
| | P | 0.5 | | | | | | | | | |
| 4 | Fe | 85 | 0.035 | 10 | 27.0 | 1820 | 69 | 70 | 121 | 141 | 0.57 |
| | P | 0.8 | | | | | | | | | |
| | Co | 1.8 | | | | | | | | | |
| 5 | Fe | 85 | 0.03 | 13 | 32.0 | 1905 | 66 | 67 | 116 | 136 | 0.57 |
| | P | 0.8 | | | | | | | | | |
| | Co | 1.8 | | | | | | | | | |
| A | Fe | 88 | 0.04 | 10 | 24.0 | 1150 | 71 | 72 | 137 | 153 | 0.52 |
| | P | 0.5 | | | | | | | | | |
| | Co | 1.9 | | | | | | | | | |
| B | Fe | 85 | 0.035 | 12 | 29.1 | 1362 | 69 | 70 | 128 | 145 | 0.54 |
| | P | 0.5 | | | | | | | | | |
| | Co | 1.8 | | | | | | | | | |
| C | Fe | 84 | 0.025 | 15 | 35.2 | 1526 | 68 | 69 | 124 | 140 | 0.55 |
| | P | 0.5 | | | | | | | | | |
| | Co | 1.8 | | | | | | | | | |

A comparison of the data of the table above clearly demonstrates that the metallic particles of this invention have higher coercivities for a given specific surface area than the metallic particles obtained from acicular goethite or lepidocrosite particles having specific surface areas within the same range.

EXAMPLE 6

The metallic particles produced in Example 1 were used to form a magnetic tape in the following manner. A mixture of 70 grams of the metallic particles, 55 grams of tetrahydrofuran, 2.5 grams of soybean lecithin and 65 grams of a 15% solution of a thermoplastic polyurethane elastomer (Estane 5701) in tetrahydrofuran was charged to a 1-pint paint can containing 150 ml. of ⅛" stainless steel balls, and an additional 65 ml. of tetrahydrofuran were added to the charge to provide good wetting. The can was placed on a Red Devil paint shaker for 1¾ hours, after which time an additional 66 grams of the polyurethane solution, 5.7 grams of a 50% solution of an aromatic polyisocyanate (Mondur CB) in methyl isobutyl ketone/ethyl acetate (2/1) and 1.0 gram of a 5% solution of ferric acetylacetonate in tetrahydrofuran were added to the milled charge, and the can was returned to the shaker for 30 minutes. The resulting dispersion, following filtration, was applied as a coating to a length of 6¼" of polyethylene terephthalate film using a Beloit knife coater with a 3 kilogauss orientation magnet at a film speed of 60 feet/minute. The coated film was air dried in a 13 foot drying tunnel at 88° C. and the dried tape was slit to ¼" width. The slit tape exhibited the following magnetic properties when measured in the machine direction with a vibrating sample magnetometer at a field strength of 10,000 oersteds:

Coercivity ($H_c$)—1350 oersteds
Remanence ($B_r$)—2520 gauss
Maximum Inductance ($B_m$)—3500 gauss
Squareness ($B_r/B_m$)—0.76.

The tape performed well in audio and video applications.

What I claim and desire to protect by Letters Patent is:

1. Acicular ferromagnetic metallic particles consisting essentially of iron and having an average diameter of 0.03 to 0.1 micron, a length to diameter ratio from about 5/1 to about 13/1, a specific surface area by the BET nitrogen method within the range of 20 to 45 $m^2$/gram and a coercivity in oersteds equal to at least the value defined by the equation $$\text{coercivity} = 1300 + 50\ (S-20)$$

where S is the specific surface area and is 20 to 30 $m^2/g$, or a coercivity greater than 1800 oersteds when the specific surface area is greater than 30 $m^2/g$, said coercivity being measured on dry, stable powder at a field strength of 10,000 oersteds and a packing density of 1.0 gram/$cm^3$.

2. The particles of claim 1 containing from 0.2 to 2% of phosphorus and from 0.5 to 5% cobalt, based on the particle weight.

3. A process for the production of acicular ferromagnetic metallic particles having high coercivity, which process comprises:

(a) forming an alkaline aqueous suspension of amorphous ferric hydroxide containing a growth effective amount of a water soluble growth regulator selected from the group consisting of organic phosphonic acids, hydroxycarboxylic acids, salts of said acids and esters of said acids;

(b) heating said suspension in a closed vessel at 100° to 250° C. until substantially all of the amorphous ferric hydroxide is converted into acicular particles of $\alpha$-$Fe_2O_3$ having an average diameter of about 0.02 to 0.2 micron, a length:diameter ratio of 2:1 to 20:1 and a specific surface area by the BET nitrogen method of 10 to 100 $m^2$/gram; and (c) reducing the $\alpha$-$Fe_2O_3$ particles into ferromagnetic iron particles in a gaseous reducing atmosphere at a temperature of about 300°–400° C.

4. The process of claim 3 wherein the $\alpha$-$Fe_2O_3$ particles are coated with a water-soluble phosphoruscontaining compound and a cobalt compound prior to reduction into iron particles.

* * * * *